US005796294A

United States Patent [19]

Perry

[11] Patent Number: 5,796,294

[45] Date of Patent: Aug. 18, 1998

[54] CIRCUITS FOR GENERATING A CURRENT WHICH IS PROPORTIONAL TO ABSOLUTE TEMPERATURE

[75] Inventor: Colin L. Perry, Swindon, United Kingdom

[73] Assignee: Plessey Semiconductors Limited, Wiltshire, United Kingdom

[21] Appl. No.: 667,962

[22] Filed: Jun. 19, 1996

[30] Foreign Application Priority Data

Oct. 31, 1995 [GB] United Kingdom ..... 9522274

[51] Int. Cl.[6] ..... G05F 1/10

[52] U.S. Cl. ..... 327/538; 327/513

[58] Field of Search ..... 327/374–377, 327/432, 440, 512, 513, 538–541, 543–546

[56] References Cited

U.S. PATENT DOCUMENTS

| | | | |
|---|---|---|---|
| 4,902,915 | 2/1990 | Tran | 327/539 |
| 5,408,136 | 4/1995 | Ovens et al. | 327/374 |
| 5,459,427 | 10/1995 | Chambers et al. | 327/539 |
| 5,578,960 | 11/1996 | Matsumura et al. | 327/538 |
| 5,614,815 | 3/1997 | Yamagata et al. | 327/538 |

*Primary Examiner*—Timothy P. Callahan
*Assistant Examiner*—My-Trang Nu Ton
*Attorney, Agent, or Firm*—Kirschstein, et al.

[57] ABSTRACT

A current reference cell is used to generate stable currents using a voltage reference source such as a band gap reference voltage in order that the output current $I_{out}$ can be proportional to absolute temperature, making the reference cell suitable for providing the bias current of a bipolar transistor in order that dynamic changes of collector current will be proportional to corresponding changes of base emitter voltage irrespective of temperature. The invention is concerned with rapidly turning off such a current $I_{out}$, and a switch such as transistor Q7 is provided which is put into saturation when the reference voltage and hence reference cell are turned off, in order that current decaying via any large capacitor such as C1 connected to the output of the reference cell is diverted through such a switch rather than through the reference cell.

6 Claims, 4 Drawing Sheets

CIRCUITS FOR GENERATING A CURRENT WHICH IS PROPORTIONAL TO ABSOLUTE TEMPERATURE

BACKGROUND OF THE INVENTION

This invention relates to circuits for generating a current which is proportional to absolute temperature (PTAT), and is particularly concerned with the promotion of a rapid decay of the current when the supply voltage is turned off.

The invention is especially concerned with circuits using bipolar devices in which the gain (transconductance) is inversely proportional to absolute temperature, in order that the gain of the bipolar devices may be independent of temperature, by using the PTAT current as bias current.

It is important to be able to remove such bias currents rapidly in order to reduce power consumption. For example, an integrated circuit may contain circuits which are switched off frequently, and a rapid turn off of bias currents can be instrumental in prolonging battery life. This could be very important in devices intended to have minimum power consumption, such as radio receiver integrated circuits for paging receivers.

The problem with attempting to turn off such bias currents rapidly is that, in order that they are independent of the supply voltage, integrated circuits (FIG. 1) often contain a voltage reference cell, typically a band gap (the energy band gap of a base-emitter junction is used to produce a precise stable reference source of 1.26 volts) and, for reasons of stability and noise decoupling, the voltage reference cell may have a large capacitor (C1) placed across its output. When it is desired to switch the integrated circuit off this large capacitor will cause the voltage reference to decay slowly, along with the bias currents generated from it. For example a pnp switch QP1 (FIG. 2) may be operated from a battery economize, control BEC via an interface circuit to switch off $I_{out}$ and other bias currents. Referring to FIG. 3, as an example the current through switch QP1 could be on for a period of one second, but could take as long as one tenth of a second to decay. The dotted line shows an enable function controlling the battery economize, control BEC. In the case of a radio receiver integrated circuit for some types of radio paging, the integrated circuit may be required to switch on and off many types a second, with the result that undue current would be taken during the switch off periods.

In FIG. 2, the voltage reference cell is shown as a known band gap voltage reference, and the bias current $I_{out}$ is shown being produced by a known peaking current source current reference cell, the outline of which is shown dotted. The peaking current source derives its name from the characteristic of $I_{out}$ bias current against $I_{in}$ (FIG. 4), since $I_{out}$ passes through a maximum as $I_{in}$ increases, and $I_{out}$ is relatively insensitive to changes in $I_{in}$ in the region of the peak. Such a reference cell is provided in order to provide a well defined output current even if there are small variations of the current through R8 due to its value or the bandgap reference changing. The input current $I_{in}$ to the reference cell is defined by R8, and R9 is connected across the bases of matched npn transistors Q8 and Q9. Because of the peaking shape of the characteristic, $I_{out}$ at the peak is proportional to absolute temperature (degrees K) (FIG. 5).

SUMMARY OF THE INVENTION

It is an aim of the invention to promote more rapid decay of the current drawn by the integrated circuit when the voltage reference cell has been disabled. While $I_{out}$ may be typically 10 μA, firstly, this current is multiplied upwards in the chip, and there might be 2 mA currents related to it and, secondly $I_{out}$ is not proportional to $I_{in}$ in the sense that if $I_{in}$ dropped to half its value $I_{out}$ would perhaps only drop from 10 μA to 8 μA.

It has been proposed to promote rapid decay of the bias currents when the voltage reference cell is disabled. Referring to FIG. 6, a switch has been proposed to speed up the discharge of the capacitor C1 across the voltage reference cell. Thus, transistor Qp2 is off when terminal BEC is at the potential VCC, but switches on when terminal BEC is brought to the same potential as ground VEE, when the BEC (battery economise control) signal switches the band gap voltage reference off capacitor C1 now discharges through Qp2 to VEE. However transistor Qp2 only discharges capacitor C1 rapidly before the band gap voltage reference collapses to the $V_{be}$ diode drop across transistor Qp2 of 0.7 volt, because thereafter Qp2 is turned off and cannot discharge C1 at such a rapid rate. Further, because of tolerances in components, it might be that transistor Q8 is still conducting at this time, and the effect of this is that the band gap voltage reference thereafter collapses at the original slow rate of 100 μs referred to in FIG. 3. In fact the current $I_{out}$ continues to be significant until the potential difference between BEC and VEE has fallen to less than about 0.6 volts. It turns out that the rate of collapse of the band gap voltage reference can still be in the region of 10 to 20 μs, which is still significant.

The invention provides a circuit for generating a current which is proportional to absolute temperature, comprising a current source generated from a voltage reference source, a circuit for generating an output current which passes through a maximum as an input current derived from the current source increases and is relatively insensitive to changes in the input current in the region of the maximum, and a path, including a switch, for connecting the current source to ground when the current source is turned off, so as to divert the input current to ground to promote rapid decay in the output current.

Instead of promoting a rapid decay of the current when the supply voltage is turned off by attempting to discharge any capacitors which delay the collapse of the current, a conductive path is provided for diverting the current source to ground away from the peaking current circuit.

BRIEF DESCRIPTION OF THE DRAWINGS

The invention will now be described in detail, by way of example, with reference to the accompanying drawings, in which.

Like reference numerals are used for like components throughout all the Figures.

DETAILED DESCRIPTION OF THE PREFERRED EMBODIMENT

Figure 1:
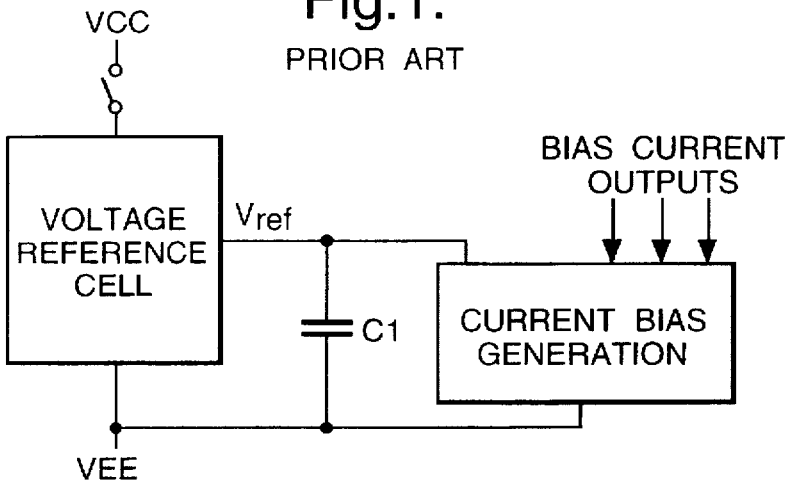
Fig.1. PRIOR ART
FIGS. 1–6 are circuit diagrams of a circuit in accordance with the prior art.
Figure 2:
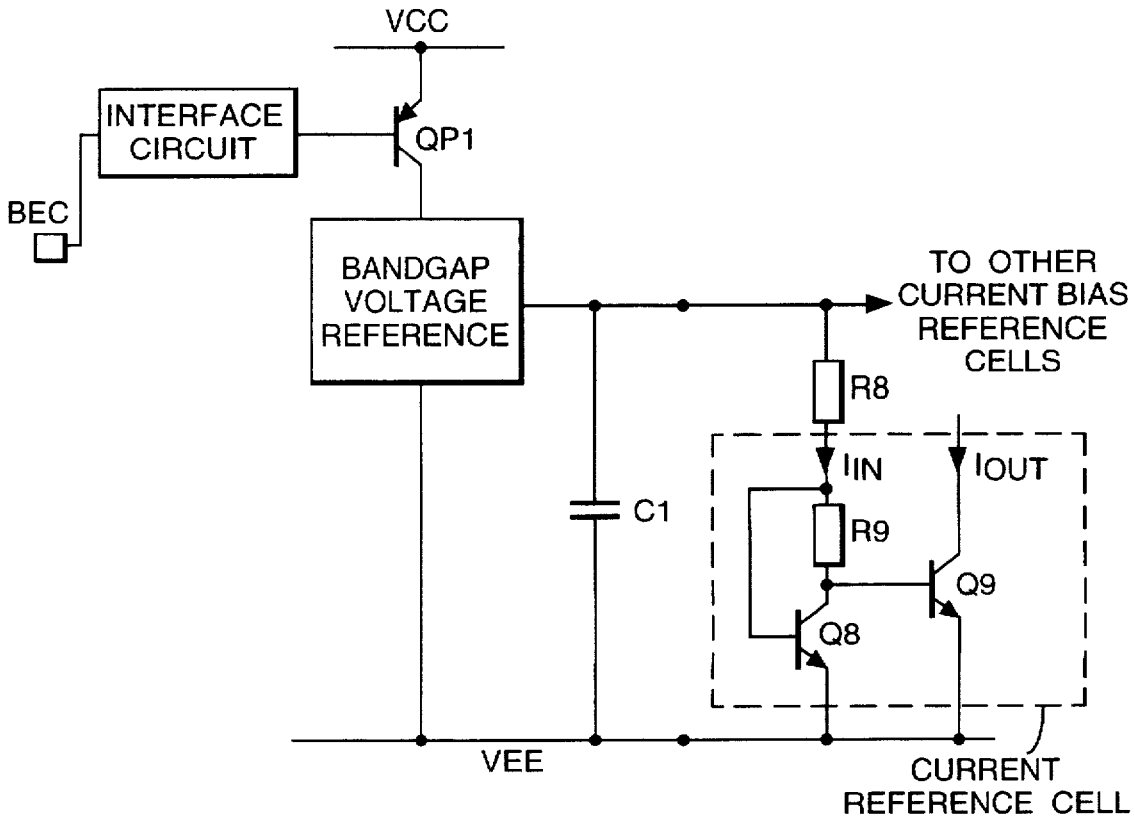
Fig.2. PRIOR ART
Figure 3:
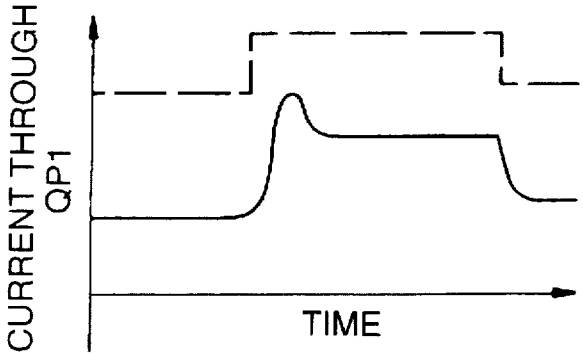
Fig.3. PRIOR ART
Figure 4:
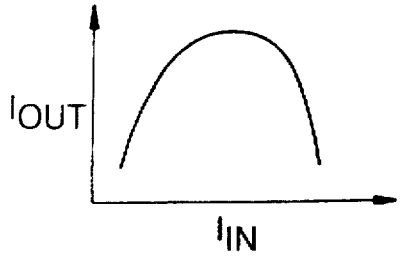
Fig.4. PRIOR ART
Figure 5:
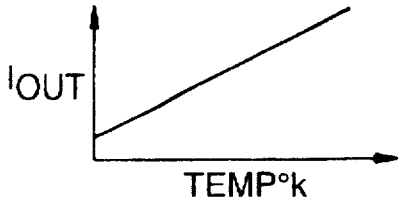
Fig.5. PRIOR ART
Figure 6:
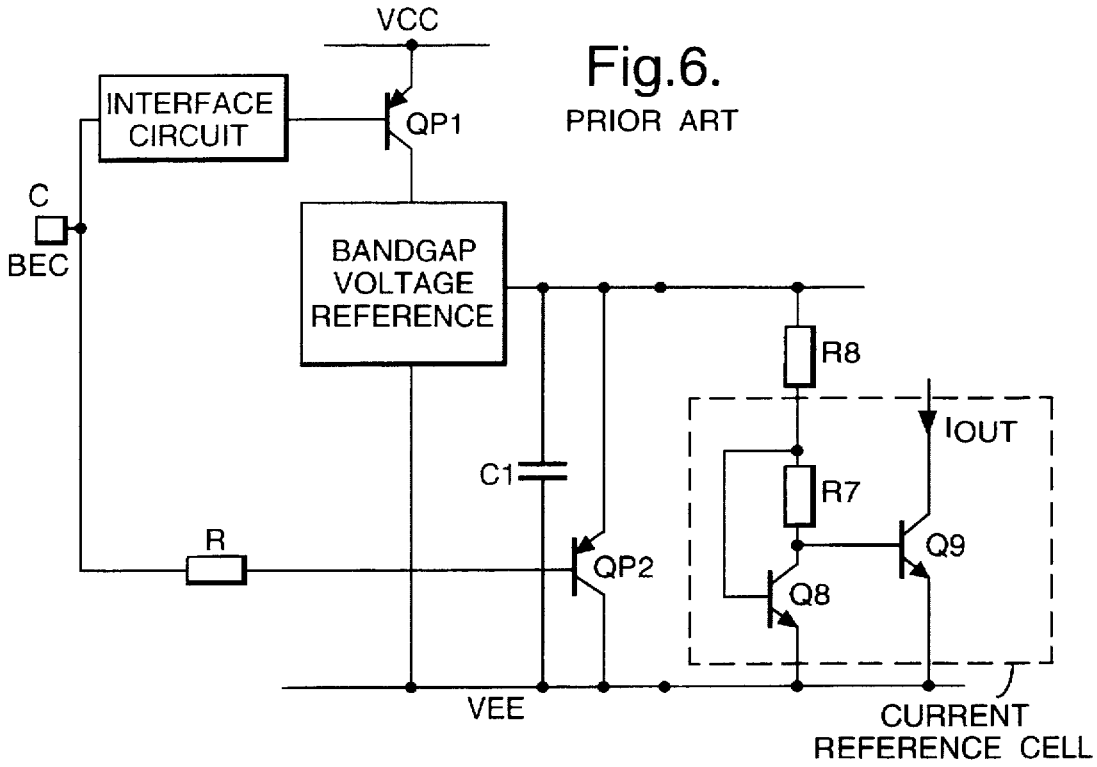
Fig.6. PRIOR ART
Figure 7:
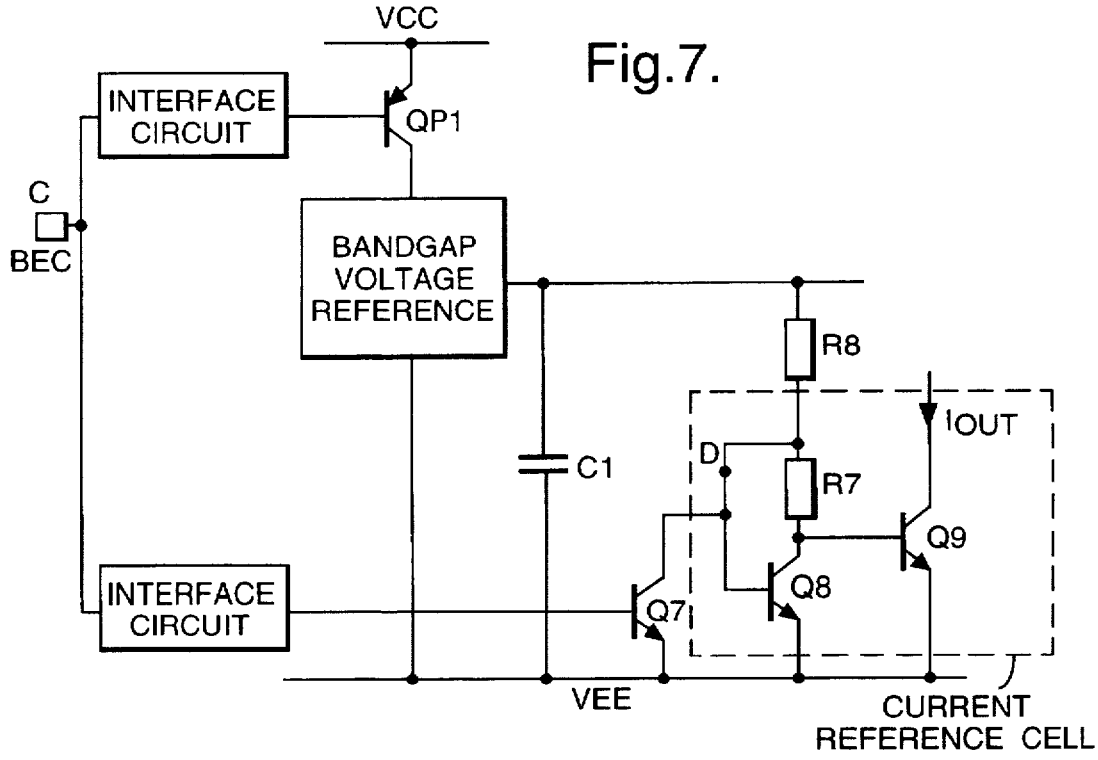
FIG. 7 is a circuit diagram of a circuit which shows the principle of the invention.

Referring to FIG. 7, the basic difference from the previous attempt at promoting rapid current decay of FIG. 6, is that a transistor Q7 is switched fully on/by an interface circuit when BEC goes to a logic level turning band gap voltage reference off, by pulling the base of Q7 towards VCC. Q7 is turned hard on and goes into saturation, thereby providing a path for diverting current $I_{in}$ through Q7 to ground, without it passing into the current reference cell to generate $I_{out}$ Q8 and Q9 are turned off hence turning $I_{out}$ off. The current through R8 is usually small, compared to the total device current, and the capacitance at node D is only that associated with the parasitics connected to that node. $I_{out}$ can therefore be almost instantaneously turned off, turning off power to the vast majority of the device. This is achieved without having to discharge the capacitor C1.

Figure 8:
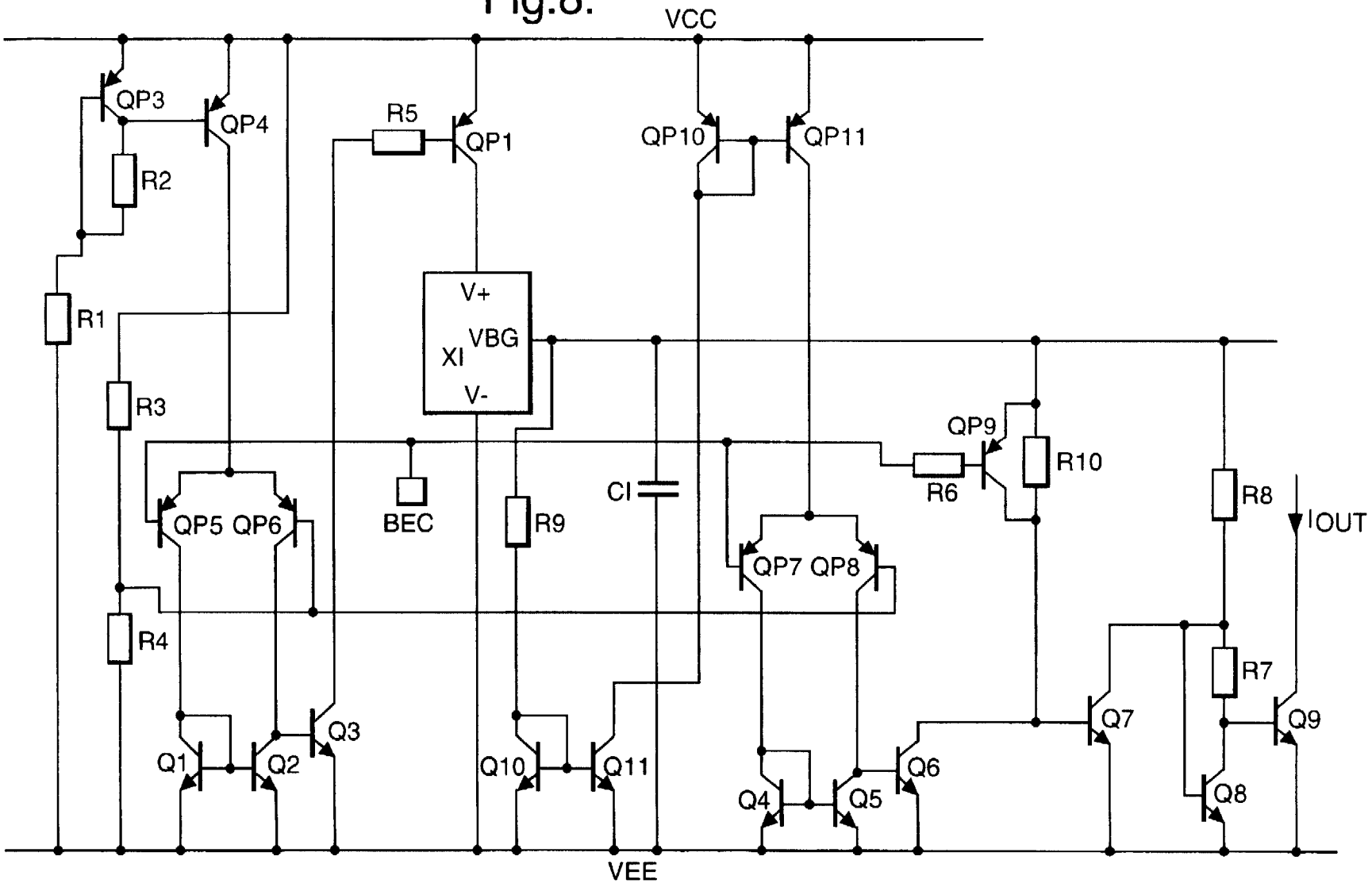
FIG. 8 is a circuit which shows a detailed implementation of the invention.

FIG. 8 shows a possible detailed implementation. The circuit is designed such that when the BEC pin is at VCC, the integrated circuit will be on i.e. $I_{out}$ will be generated. When BEC is at VEE, the integrated circuit will be off, i.e. $I_{out}$ will be practically zero.

X1 is a voltage reference cell that generates a band gap voltage VBG. As previously explained, QP1 is a pnp switch to turn X1 off and on, and the circuitry QP5, QP6, Q1, Q2, Q3 and R5 provide the interface between the BEC pin and QP1. The resistors R3 and R4 are high value, usually several megohms, to minimize, standby current, and are used to set the switching voltage point for the BEC pin. In the example shown, if R3 and R4 have equal values, the voltage switching point of BEC is (VCC–VEE)/2.

Transistors QP3, QP4, R1 and R2 provide a very small bias current to provide bias current for the transistors QP5, QP6.

Transistors Q8, Q9, and resistor R7 form the peaking current source previously described. The current $I_{out}$ is replicated many times in the integrated circuit to provide bias currents for various functions in the integrated circuit (not shown).

C1 is the capacitor, often large in value, used for stability and decoupling of the VBG output voltage.

Resistor R9, transistors Q10, Q11, QP10 and QP11 provide a small bias current for the transistors QP7 and QP8. Transistors QP7, QP8, Q4, Q5, Q6, QP9, R6 and R10 provide the interface for switch Q7.

In operation, when terminal BEC is at VCC, VBG is enabled and the device is on. Transistors QP7 and QP9 are off, QP8 being on. This turns current mirror Q4, Q5 off and therefore Q6 is biased on by the collector current of QP8 which pulls the base terminal of Q7 low, turning switch Q7 off. This enables the bias generation circuit Q8, Q9, R7 and R8 to function to produce $I_{our}$.

When BEC is set to VEE to disable voltage reference cell X1, transistor QP7 is turned on and transistor QP8 turned off, turning current mirror Q4, Q5 on turning Q6 off. The current that flows via resistor R10 now flows into the base of Q7 turning it on, which turns transistors Q8 and Q9 off, and hence $I_{out}$ off. Transistor QP9 is provided, with base current limiting resistor R6, such that when BEC is taken to VEE, a larger current than that provided by R10 is used to very rapidly turn Q7 hard on, and hence Q8 and $I_{out}$ off. This enables R10 to be kept at a higher value, and hence reduce its power dissipation when BEC is at VCC. R10 is needed to keep Q7 on as QP9 will saturate and the base current supplied via R6 will be reduced, and hence its collector current will be very reduced, when VBG has fallen to around 0.8 to 0.9 volts.

The integrated circuit may form part of the circuit for the receiver of an R.F. pager, which could operate at between 150–500 MHz carrier frequency and operate at a data rate of between 512 and 2400 bits per second. The integrated circuit could provide a data output in 1.0 format for a microprocessor to interpret the data. Typically, VCC is 2.7 volts and VEE is ground, but the circuitry described could be used for controlling circuitry run off a lower VCC value of typically 1.3 volts.

With the circuit of the invention, it is possible for the band gap reference voltage to collapse within as little as 1ms from being disabled.

Of course variations may be made without departing from the scope of the invention. Thus, the voltage reference cell need not be a band gap voltage reference but other types e.g. CMOS voltage reference circuits could be used. Other types of peaking current sources could be employed instead of that indicated by transistors Q8, Q9 and resistor R7, and $I_{out}$ need not be used for bias currents. FETs could be used in place of the bipolar transistors apart from in the peaking current source.

I claim:

1. A circuit for generating a current which is proportional to absolute temperature, comprising:

a) a current source having an input node coupled to a voltage reference source, and an output node;

b) a sub-circuit for generating an output current which passes through a peak value as a variable input current derived from the output node of the current source increases, said output current being relatively insensitive to changes in the variable input current in a region of the peak value thereby rendering the output current proportional to absolute temperature; and c) a path, including a switch, for connecting the output node of the current source to ground when the current source is turned off, for diverting the variable input current to ground to promote rapid decay in the output current.

2. The circuit as claimed in claim 1, in which the switch includes a transistor that saturates when the current source is turned off.

3. The circuit as claimed in claim 2, in which the transistor is a bipolar transistor having a base connected to a voltage derived from the voltage reference source via a parallel connection of a resistor and a second transistor, said bipolar transistor being turned on when the second transistor is made conducting.

4. The circuit as claimed in claim 1, in which the current generated is a bias current.

5. An integrated circuit for generating a bias current which is proportional to absolute temperature, and for supplying the bias current to another part of the integrated circuit, comprising:

a) a current source having an input node coupled to a voltage reference source, and an output node;

b) a sub-circuit for generating an output current which passes through a peak value as a variable input current derived from the output node of the current source increases, said output current being relatively insensitive to changes in the variable input current in a region of the peak value thereby rendering the output current proportional to absolute temperature; and c) a path, including a switch, for connecting the output node of the current source to ground when the current source is turned off, for diverting the variable input current to ground to promote rapid decay in the output current.

6. The integrated circuit as claimed in claim 5, in which said other part of the integrated circuit includes a radio receiver for a radio frequency pager.

* * * * *